US005524698A

United States Patent [19]

Chen et al.

[11] Patent Number: 5,524,698

[45] Date of Patent: Jun. 11, 1996

[54] METHOD OF MAKING A ONE-BODY PRECISION CAST METAL GOLF CLUB HEAD

[75] Inventors: Chun-Mu Chen, Hsinchu Hsien; Chih-Chao Yang, Tainan, both of Taiwan

[73] Assignee: Industrial Technology Research Institute, Taiwan

[21] Appl. No.: 366,764

[22] Filed: Dec. 30, 1994

[51] Int. Cl.[6] ..... B22C 1/00; B22C 3/00

[52] U.S. Cl. ..... 164/72; 164/138; 164/369

[58] Field of Search ..... 164/72, 369, 138, 164/6; 249/135

[56] References Cited

U.S. PATENT DOCUMENTS 5,261,478 11/1993 Sun ..... 164/132

5,289,865 3/1994 Sun ..... 164/132

5,355,933 10/1994 Voss ..... 164/120

*Primary Examiner*- Jack W. Lavinder

*Assistant Examiner*- Randolph S. Herrick

*Attorney, Agent, or Firm*- Michael D. Bednarek; Marks & Murase

[57] ABSTRACT

A one-body hollow precision cast metal golf club head is fabricated by casting metal about a head core to form a shell, and melting and flowing out the head core. The head core is made of low melting point alloys having a melting point lower than that of the metal used for casting the shell and is coated with an aqueous solution prior to the casting process of the shell. The aqueous solution is a composition including inorganic powders, binders and solvent. The ratio of components should be inorganic powder:binder:solvent = (40–80):(1–10):(10–59) based on weight.

21 Claims, 1 Drawing Sheet

METHOD OF MAKING A ONE-BODY PRECISION CAST METAL GOLF CLUB HEAD

FIELD OF THE INVENTION

The present invention relates to a method of making a one-body precision cast metal golf club head, and in particular to a method of making a one-body hollow precision cast metal golf club head by casting metal about a head core made of a low melting point metal to form a shell, and melting and flowing out the head core.

BACKGROUND OF THE INVENTION

Conventionally, hollow cast metal golf club heads are fabricated by, for example, first fabricating two half shells, i.e., an upper shell body and a lower shell body, by for example, the investment casting process, and then welding the two half shell bodies together. This method has the disadvantage of high manufacturing cost. Another method for the fabrication of hollow cast metal golf club heads is the metal die gravity casting method, which uses a sand core to form the hollow cavity of a golf club head. However, by this method, rough surface cast metal golf club heads are obtained, which require further polishing treatment.

The high pressure die casting method has been used recently in the fabrication of cast metal golf club heads, because according to this method, the golf club heads can be integrally fabricated without welding and the fabricated golf club heads have a smooth surface. In addition, golf club heads fabricated by this method usually have high strength, and the traces of the identifications or trademarks to be coined on the club heads can be sharp and be clearly seen.

U.S. Pat. Nos. 5,261,478 and 5,289,865 issued to Donald J. C. Sun disclose two methods of making a golf club head. The disclosed methods include forming a head core consisting of a mixture of particles of sand in a binder; providing at least one core arbor or rod extending into the core and also externally thereof; casting molten lightweight metal about the core and about the arbor to form the shell walls of the golf club head; and removing the core arbor from the head core thereby to form an opening, and removing the head core via the opening.

However, according to this method, as the core is structurally weak, and thus breaks easily, it is not possible to apply higher pressure during the subsequent high pressure die casting process, thereby resulting in the poor quality and strength of the fabricated cast metal golf club heads. Furthermore, according to the method of said patent, although the head core is coated with a barrier coating against the penetration of molten die cast metal into the solidified sand core prior to the molten lightweight metal being cast about the core, the molten metal will still penetrate into the crevices formed between sand particles, thus resulting in the incomplete removal of the core particles, which affects the weight and shifts the center of gravity of the final golf club head. In order to remove the core particles, according to the method of Sun, the binder of the sand core should be incinerated at a high temperature. This additional step will increase the manufactruring cost. Moreover, as sand cores easily collapse, and do not have sufficient strength, a positioning core arbor must be provided extending into the core during the formation of sand cores. This step complicates the fabricating process. Also, by the method as disclosed in said U.S. patent, the hosel opening of the golf club head can not be integrally formed with the club head by using a sand core, and must be formed by using the cylinder slide method. This also complicates the casting molds and thus only one golf club head is produced from one casting mold during one run.

SUMMARY OF THE INVENTION

An object of the present invention is to substantially eliminate the defects and drawbacks encountered to the prior art described above.

According to the method of the invention, the one-body precision cast metal golf club head is produced by a method including fabricating a head core of low melting point metal; coating the head core with an aqueous composition including inorganic powders, binders and solution, and drying; casting molten metal about the coated head core to form a shell; and removing the head core by melting the head core.

According to an aspect of the method of the invention, the low melting point metal has a melting point lower than that of the metal for forming the shell, and the head core is heated at a temperature between the liquidus temperature of the low melting point metal and the solidus temperature of the metal for forming the shell.

According to another aspect of the method of the invention, the head core is provided with a tapered positioning protrusion at the planned hosel opening, and which is inserted into a corresponding tapered recessed portion formed in the casting die sections during the casting process of the shell to firmly position the head core in the cavity.

BRIEF DESCRIPTION OF THE DRAWINGS

Other objects, features and advantages of the present invention will becomes apparent upon consideration of the specification and the appended drawings, in which.

DETAILED DESCRIPTION OF THE INVENTION

Figure 1:
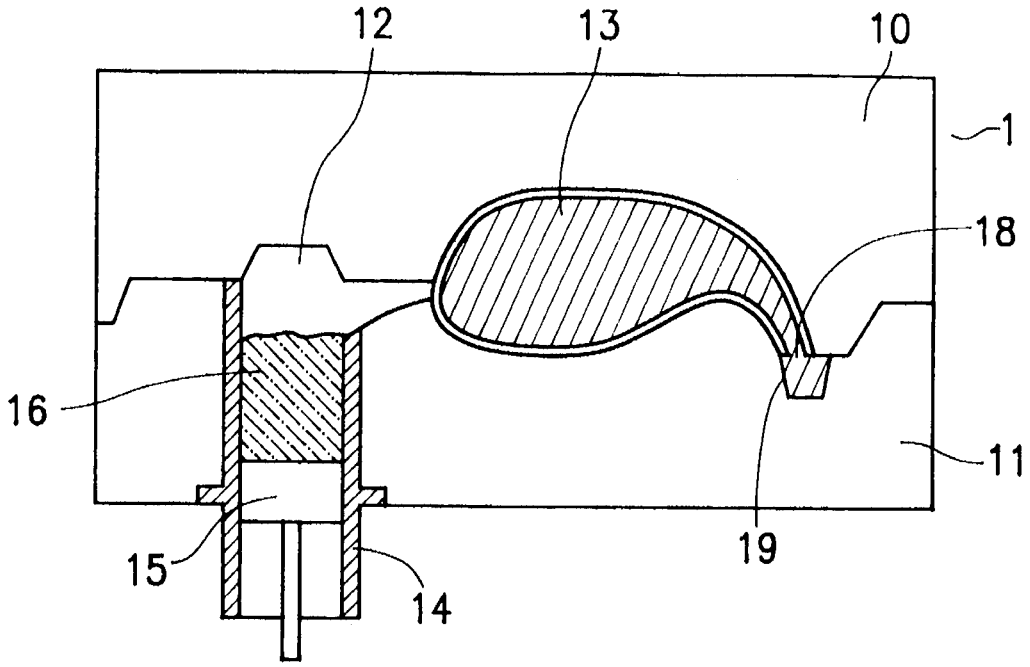
FIG. 1 is a sectional view showing the head core placed in the cavity of golf club head forming die sections for casting shell about the head core according to the method of the invention.

According to the present invention, the first step is to fabricate a head core of low melting point metal. The fabrication of the head core can be performed by a general-use process, for example, by the gravity casting process, low pressure casting process or high pressure casting process. Note that the materials for fabricating the head core should be low melting point metal which will not melt or soften during the subsequent high pressure die casting process to form the shell, and will not make the shell become partially melted or distorted during the melting and flowing out process. To meet the above two requirements, materials for the head core should have a melting point which is lower than that of material to be used for casting the shell.

Preferred low melting point metals include but are not limited to zinc alloys, for example, Zn—Al—Cu, Zn—Al—Mg, Zn—Sn—Cu, and Zn—Sn—Mg alloys. The inclusion of copper or magnesium in the zinc alloys is to increase the mechanical strength of the cast head core, and the amount of Cu and Mg is 0–1 percent by weight based on the total weight of the alloy according to the method of the invention. The inclusion of aluminum or tin is to increase the flowability of the molten zinc alloys, and to reduce the reaction of the head core with the shell metal. If aluminum is to be added, the amount should be in the range of 0–5 percent by weight based on the total weight of the alloy. If the amount exceeds 5 wt %, primary crystalline aluminum is produced, and will remain inside the shell body of the golf club head when the head core is melted and flowed out from the shell body. The tin should be added in an amount of 0–30 wt % based on the total weight of the alloy. If the amount exceeds 30 wt %, the melting point of the head core will become too low, and thus result in partial melting of the portion of the cast head that is in proximity to the ingate body during the subsequent high pressure die casting process of the shell.

To provide a barrier against the reaction of the molten core metal with the shell metal during the melting and flowing out process of the head core so as to prevent the fabricated club head from breakage, according to the method of the invention, it is necessary to coat the cast head core with an aqueous composition including inorganic powders, binders and solvent. Inorganic powders suitable for use are talc, mica, quartz, gypsum, boron nitride, silicon nitride, sulfide, phosphide, metal oxide powder or the mixture thereof. Binders, for example, silica gel, water glass, ethyl acetate or the mixture thereof can be used. The solvent for the inorganic powder and binder includes water and alcohols. Note that the ratio of the components should be inorganic powder:binder:solvent=(40–80):(1–10):(10–59) based on weight. The coating is applied to the surface of the head core by, for example, brushing, spraying or dipping into a coating solution. The coating should be dried before the head core is placed into cavities of head core forming die sections.

Referring to FIG. 1, a casting mold 1 consisting of an upper die section 10 and a lower die section 11 is utilized for casting a shell about coated and casted head core 13. Note that at the planned hosel opening of the head core 13 is formed with a positioning protrusion 18. The positioning protrusion 18 is tapered and has a polyhedral cross section, such as a rectangular section, a hexangular section or a octangular section. The head core 13 is placed in cavity 12 formed between upper die section 10 and lower die section 11. Lower die section 11 has a recessed portion 19 which is tapered and has a polyhedral cross section, corresponding to positioning protrusion 18. Positioning protrusion 18 is inserted into said recessed portion 19 so that when upper die section 10 and lower die section 11 are firmly closed and molten metal 16 contained in cylinder 14 is injected into cavity 12 by piston 15, head core 13 is firmly positioned in cavity 12, and is not affected by injected molten metal 16 during high pressure die casting process. It is also to be noted that the positioning protrusion of the head core can also be formed at the location where a counter weight is to be attached, usually a hole is formed for fixing the counter weight (not shown).

Figure 2:
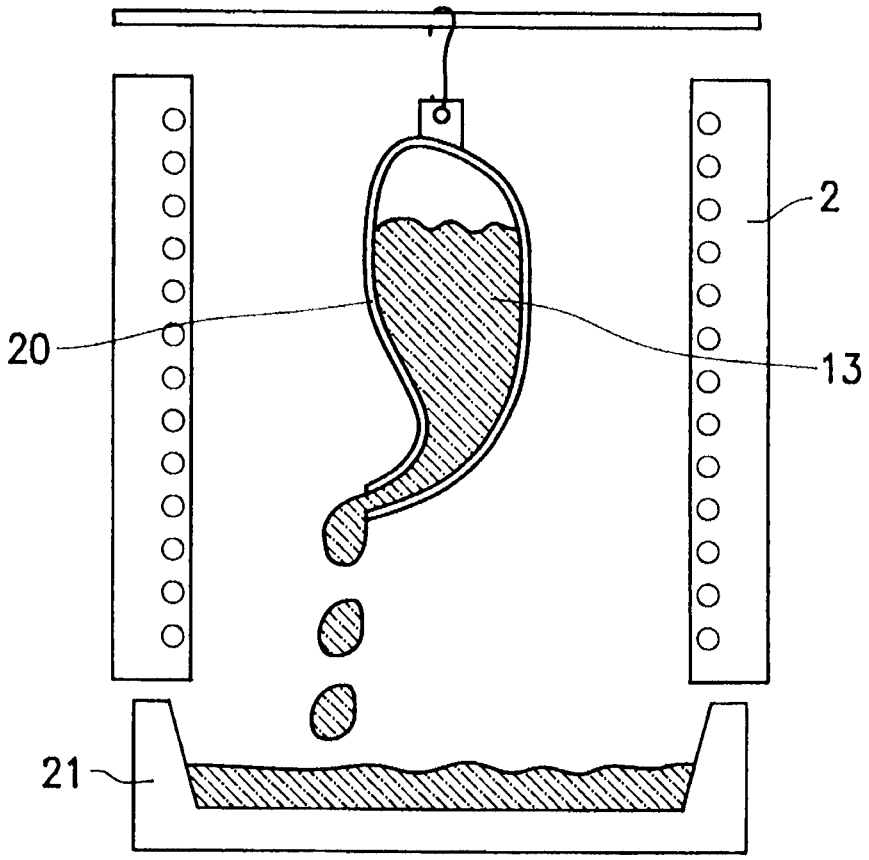
FIG. 2 is a vertical sectional view showing the head core in the fabricated shell melting and flowing out according to the method of the invention.

Referring now to FIG. 2, the casted shell 20 together with the head core 13 is melting in a furnace 2. Note that the furnace temperature should be lower than the solidus temperature of the shell metal to prevent the shell from distortion, and should be higher than the liquidus temperature of head core 13, otherwise head core 13 can not be melted and flowed out. The melted head core 13 is received in a container 21 for recycled.

The invention will now be described in greater detail with reference to the following non-limiting example.

EXAMPLE

In this example, zinc alloy (Zn—Sn—Cu) containing 20 wt % of Sn and 0.5 wt % of copper was fabricated into head core by the normal die casting process. The planned hosel opening of the head core was formed with a tapered positioning protrusion having a rectangular section. The head core was then coated with an aqueous solution by brushing. The aqueous solution was prepared by mixing iron oxide powder with water glass (1 wt %) in water. The coated head core was dried at a temperature of 120° C. in an oven for 2 hours.

The coated and dried head core was then placed in the cavity of a die casting mold as shown in FIG. 1 with its positioning protrusion being inserted into the recessed portion formed in the lower die section. A356 aluminum alloy was melted at 720° C. and poured into the cylinder and injected into the cavity. The injection pressure was 800 $kg/cm^2$ and maintained for 30 seconds after the molten aluminum alloy was filled in the cavity. The cast golf club head was then ejected out and placed in a furnace as shown in FIG. 2 for 4 hours to melt and flow out the head core. The furnace was maintained at a temperature of 520° C.

After the melted head core was flowed out, the head shell was subjected to a 170° C., low temperature aging treatment. After the heat treatment, the cast golf club head was polished to finish the process.

According to the manufacturing method of the invention, as the core is made by metal, the subsequent casting pressure for die casting the shell body can be increased without causing distortion of the final club head, and thus the quality and strength of the cast golf club head is improved. The head core is precisely positioned in the cavity by inserting a tapered protrusion into a corresponding recessed portion formed in die section, and thus the fabricated club head has a uniform thickness on the ball striking face, top wall and bottom wall. The hosel opening can be integrally formed with the head core according to the method of the invention to save the cost of tooling. Furthermore, the melted head core can be recycled and the melting process of the head core can be carried out along with the final heat treatment to the cast club head to reduce the manufacturing cost.

We claim:

1. A method of making a one-body precision cast metal golf club head comprising a shell, comprising the following steps:

(a) forming a head core made of a Zn—Al—Y alloy wherein Y may be Cu or Mg, and the amount of Cu and Mg is 0–1 percent by weight and the amount of Al is 3–5 percent by weight;

(b) coating said head core with an aqueous composition including inorganic powder, binder and solvent, and drying, wherein the weight ratio of inorganic powder:binder:solvent is (40–80):(1–10):(10–59);

(c) casting molten metal about said head core at a pressure of at least 100 $Kg/cm^2$ to form the shell, wherein said metal has a melting point higher than that of said metal alloy; and (d) removing said head core by heating said head core at a temperature between the liquidus temperature of said Zn—Al—Y alloy and the solidus temperature of said Zn—Al—Y alloy.

2. The method as claimed in claim 1, wherein said inorganic powder is a powder selected from the group consisting of talc, mica, quartz, gypsum, boron nitride, silicon nitride, sulfide, phosphide, metal oxide and the mixture thereof.

3. The method as claimed in claim 1, wherein said binder is a compound selected from the group consisting of silicon gel, water glass, ethyl acetate and the mixture thereof.

4. The method as claimed in claim 1, wherein said solvent is water.

5. The method as claimed in claim 1, wherein said solvent is alcohol.

6. The methods as claimed in claim 1, wherein the core head is formed by the die casting process.

7. The method as claimed in claim 1, wherein the core head is formed by the gravity casting process.

8. The method as claimed in claim 1, wherein the core head is formed by the low pressure injection process.

9. The method as claimed in claim 1, wherein the shell is formed by casting molten metal about said head core by the high pressure die casting process.

10. The method as claimed in claim 1, wherein the head core has a tapered positioning protrusion at the planned hosel opening and step (c) comprises the steps of:

(1) providing head core receiving sections which forms a cavity for receiving said head core, and one of said head core die sections having a tapered recessed portion corresponding to said tapered positioning protrusion;

(2) placing said head core in said cavity with the tapered positioning protrusion of said head core being inserted in said recessed portion; and (3) introducing said molten metal into said cavity of said head core forming sections about said head core, and solidifying said molten metal.

11. The method as claimed in claim 4, wherein the positioning protrusion has a polyhedral section.

12. The method as claimed in claim 10, wherein the positioning protrusion has a rectangular section.

13. A method of making a one-body precision cast metal golf club head comprising a shell, comprising the following steps:

(a) forming a head core made of a Zn—Sn—X wherein X may be Cu or Mg, and the amount of Cu and Mg is 0-1 percent by weight and the amount of Sn is 5-30 percent by weight;

(b) coating said head core with an aqueous composition including inorganic powder, binder and solvent, and drying, wherein the weight ratio of inorganic power:binder:solvent is (40-80):(1-10):(10-59);

(c) casting molten metal about said head core at a pressure of at least 100 kg/cm$^2$ to form the shell, wherein said metal has a melting point higher than that of said Zn—Sn—X alloy; and (d) removing said head core by heating said head core at a temperature between the liquidus temperature of said Zn—Sn—X alloy and the solidus temperature of said metal alloy.

14. The method as claimed in claim 13, wherein said inorganic powder is a powder selected from the group consisting of talc, mica, quartz, gypsum, boron nitride, silicon nitride, sulfide, phosphide, metal oxide and the mixture thereof.

15. The method as claimed in claim 13, wherein said binder is a compound selected from the group consisting of silicon gel, water glass, ethyl acetate and the mixture thereof.

16. The method as claimed in claim 13, wherein said solvent is water.

17. The method as claimed in claim 13, wherein said solvent is alcohol.

18. The methods as claimed in claim 13, wherein the core head is formed by the die casting process.

19. The method as claimed in claim 13, wherein the core head is formed by the gravity casting process.

20. The method as claimed in claim 13, wherein the core head is formed by the low pressure injection process.

21. The method as claimed in claim 13, wherein the shell is formed by casting molten metal about said head core by the high pressure die casting process.

* * * * *